United States Patent [19]

Mahar

[11] Patent Number: 4,935,975

[45] Date of Patent: Jun. 26, 1990

[54] PATIENT SUPPORT GARMENT SYSTEM

[76] Inventor: Paul J. Mahar, 7087 West Blvd., Youngstown, Ohio 44512

[21] Appl. No.: 435,979

[22] Filed: Nov. 13, 1989

Related U.S. Application Data

[63] Continuation-in-part of Ser. No. 214,764, Jul. 5, 1988, abandoned.

[51] Int. Cl.[5] ..... A61G 7/10

[52] U.S. Cl. ..... 5/81 R; 5/83; 5/89

[58] Field of Search ..... 4/560, 566, 571, 573; 5/81 R, 82, 87, 89, 424; 2/80; 294/140; 27/28

[56] References Cited

U.S. PATENT DOCUMENTS

| | | | |
|---|---|---|---|
| 1,059,815 | 4/1913 | Belles . | |
| 2,622,248 | 12/1952 | Schaye | 2/80 |
| 3,252,704 | 5/1966 | Wilson . | |
| 3,401,410 | 9/1968 | Welborn et al. | 5/86 X |
| 3,530,851 | 9/1970 | Geschickter | 5/83 X |
| 4,530,122 | 7/1985 | Sanders et al. . | |

*Primary Examiner*—Michael F. Trettel
*Attorney, Agent, or Firm*—Harpman & Harpman

[57] ABSTRACT

A patient support system for handling, manipulating, lifting and positioning disabled or incapacitated patients includes a one-piece mesh garment and a plurality of mesh engagement hooks and support lines that selectively engage the garment allowing for even gentle lifting support in variable body positions.

4 Claims, 1 Drawing Sheet

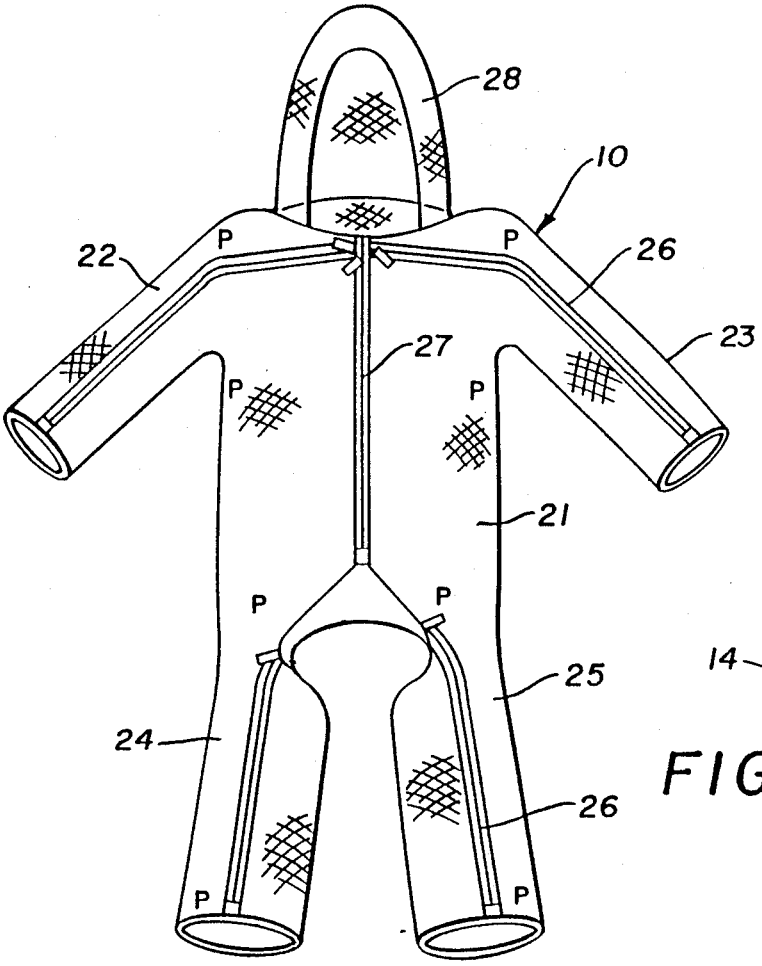
FIG. 1
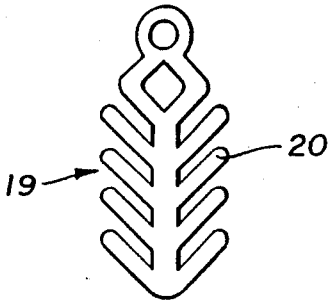
FIG. 5
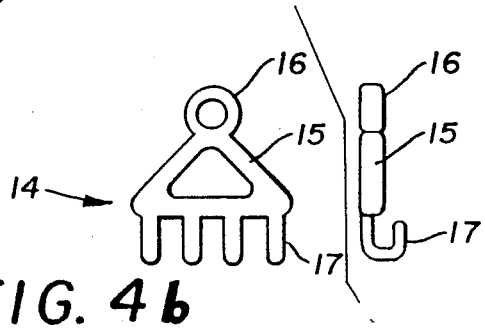
FIG. 4b
FIG. 4a
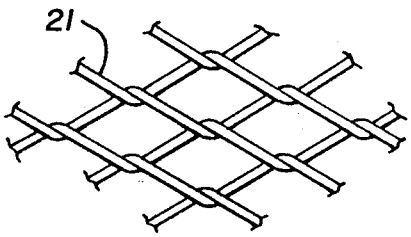
FIG. 2
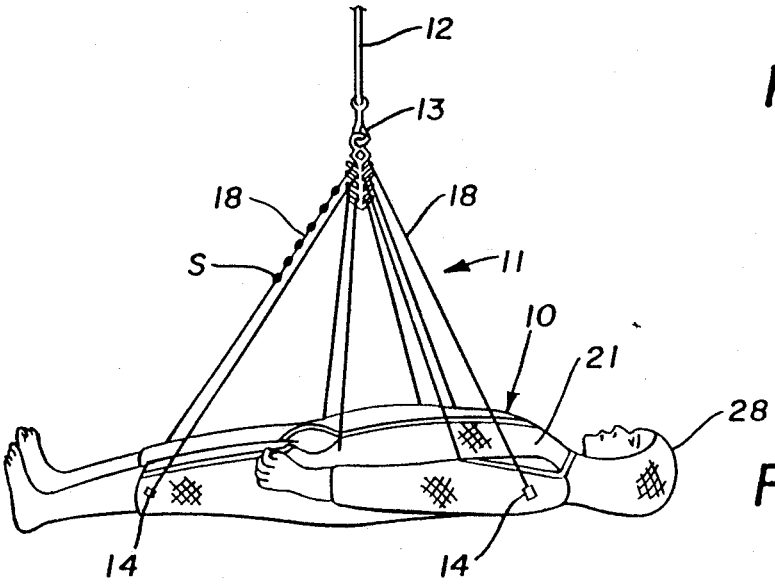
FIG. 3

PATIENT SUPPORT GARMENT SYSTEM

This is a continuation-in-part application of Ser. No. 214,764, filed July 5, 1988, now abandoned.

BACKGROUND OF THE INVENTION

1. Technical Field

This device relates to patient lifting apparatus used to lift and transport disabled individuals from one location to another by use of a support structure attached to the patient.

2. Description of Prior Art

Prior Art devices of this type have relied on a variety of different structural configurations to support and move disabled patients utilizing lift structures and body harnesses, see for example U.S. Pat. No. 1,059,815, U.S. Pat. No. 3,252,704 and U.S. Pat. No. 4,530,122.

In U.S. Pat. No. 1,359,815 an invalid's lift is disclosed wherein a jacket of fabric material is used having an open top with spaced affixed points of attachment positioned at either end of the jacket.

U.S. Pat. No. 3,252,704 discloses a lifting and walking jacket for use with a lifting boom and support structure. The jacket fits around the upper body of the patient with shoulder straps that become the points of engagement for the lifting device.

U.S. Pat. No. 4,530,122 shows a patient weight reliever apparatus that uses manual or power driven lifting device that removably secures to either a upper body jacket for use in a wheel chair configuration or a full body support frame in alternate use. The support frame is characterized by a pair of oppositely disposed parallel sides interconnected by spaced separator bars each of the sides having attached straps at the leg and torso encompassing straps.

SUMMARY OF THE INVENTION

A patient support system utilizing a flexible light weight body encapsulating form fitting mesh net garment that is fully supportive while being limited in body contact. The garment provides for unlimited points of temporary attachment by mesh engagement hooks and attached support lines for lifting and supporting the patient in a variety of body position configurations as desired.

DESCRIPTION OF THE DRAWINGS

FIG. 1 is a front plan view of the mesh support garment;

FIG. 2 is an enlarged portion of the mesh garment broken away for illustration purposes;

FIG. 3 is a side elevation of the mesh support garment;

FIG. 4*a* is an enlarged side plan view of an engagement hook;

FIG. 4*b* is an enlarged front plan view of the engagement hook; and

FIG. 5 is an enlarged front view of a multiple support line engagement juncture fitting.

DESCRIPTION OF THE PREFERRED EMBODIMENT

A patient support system can best be seen in FIGS. 1 and 3 of the drawings comprising a mesh garment 10 and lifting support interconnection elements 11 which link the mesh garment 10 with a hoist line 12 and buckle 13 for use with any form of manual or powered lifting hoist (not shown) as is well defined within the art.

Referring now to FIGS. 2,3, and 5 of the drawings the interconnection elements 11 are comprised of a plurality of mesh engagement hooks 14 each of which has a triangular shaped body member 15 with an integral eyelet 16 extending therefrom. Multiple spaced curved tines 17 are integrally formed and extend from said body member 15. The spacing of the curved tine 17 is such as to be registrable on the mesh garment 10 as will be discussed in greater detail later.

A plurality of support lines 18 extend individually from each of said hooks 14 by engagement through the eyelet 16 and extend to a multiple line support fitting 19, best seen in FIG. 5 of the drawings. Each of the support lines 18 has a plurality of longitudinally spaced stopper knots S positioned along its length so as to be variable length engageable within the multiple line support fitting 19.

The longitudinally spaced stopper knots S as seen in FIG. 3 of the drawings define enlarged sections on the support lines 18 that can be formed by a simple knot in the line itself or alternately apertured plastic resin beads secured on the lines independently or on knots as will be well known and understood by those skilled in the art.

The line support fitting 19 has a longitudinally extending body member with a plurality of oppositely disposed spaced angular extensions 20 for engagement and selective adjustable registration of the individual support lines via stops S between the pairs of said angular extensions.

The mesh garment 10, best seen in FIGS. 1,2, and 3 of the drawings, has an internal one-piece mesh body 21 made from interlocking nylon filament cord or the like material in a mesh net configuration illustrated in FIG. 2 of the drawings. The mesh body 21 has arm extensions 22 and 23 and foreshortened leg extensions 24 and 25. The mesh body 21 has a plurality of zippered seams 26 which individually extend down the leg and arm extensions 22–25 with a central upper torso zipper 27 that intersects said arm zipper at a point just below the head portion of the garment. A removable mesh net hood 28 extending from and affixed to the mesh body 21 engages around the head of the patient, leaving their face free. The mesh engagement hooks 14 are engageable anywhere on the mesh garment, but have optimum engagement points P, illustrated in FIG. 1 of the drawings to uniformly support the patient from a horizontal position in this example.

The mesh garment 10 is very lightweight, flexible and form fitting affording the patient a convenient, strong, durable, wetable and washable with the patient completely within. It is quick drying garment that will allow health personnel or others to easily bathe, move, position and maneuver a disabled patient easily and safely by use of the hooks 14 and the support lines 18 as hereinbefore described.

The zippers 26 and 27 provide for ease of application and access to the form fitting garment which is envisioned to be worn by the patient over long periods of time.

Thus, it will be seen that a new and useful patient support system has been illustrated and described and it will be apparent to those skilled in the art that various changes and modifications may be made therein without departing from the spirit of the invention.

Therefore, I claim:

1. A patient support garment system for lifting a patient with ancillary support structure comprising in combination, a mesh net garment adapted to be form fitting on a patient, said mesh garment having a full body torso and partial arm and leg extensions, means for removably securing said mesh net garment on said patient, an adjustable support apparatus comprising mesh engagement hooks removably secured to said mesh garment, said hooks having a plurality of spaced curved tines, support lines of a known length interconnecting said engagement hooks with a line support fitting, means for adjusting said support line length relative said hooks and said support fitting.

2. The patient support garment system of claim 1 wherein said mesh garment is made of a interlocking synthetic cord.

3. The patient support garment system of claim 1 wherein said means for removably securing said mesh net garment on said patient comprises a number of interconnecting and intersecting zippers associated with said leg and arm and torso of said garment.

4. The patient support garment system of claim 1 wherein said means for adjusting said support line length comprises a plurality of longitudinally spaced stopper knots along a portion of the length of said line adjustably engaging said support fitting.

* * * * *